US005474436A

United States Patent [19]

Yamazaki

[11] Patent Number: 5,474,436

[45] Date of Patent: Dec. 12, 1995

[54] APPARATUS FOR SHAPING THE CENTER SPACE OF TOILET ROLLS

[76] Inventor: Tokuhichi Yamazaki, 2-7-6 Kunikubo, Fuji-shi, Shizuoka-ken, Japan

[21] Appl. No.: 176,443

[22] Filed: Jan. 3, 1994

[30] Foreign Application Priority Data

Jan. 20, 1993 [JP] Japan ..... 5-023409

[51] Int. Cl.[6] ..... B29C 57/00

[52] U.S. Cl. ..... 425/103; 425/106; 425/305.1; 425/392

[58] Field of Search ..... 72/355.6, 370; 242/525, 525.2; 493/288, 303, 395; 425/103, 106, 297, 305.1, 392, 403.1

[56] References Cited

U.S. PATENT DOCUMENTS

| | | | |
|---|---|---|---|
| 1,001,945 | 8/1911 | Goldner | 425/392 |
| 1,128,156 | 2/1915 | Lamb | 425/392 |
| 1,783,088 | 11/1930 | Hill | 72/370 |
| 1,922,716 | 8/1933 | Robinett | 242/1 |
| 3,106,362 | 10/1963 | Sukala, Jr. | 242/571 |
| 3,495,301 | 2/1970 | Stephens et al. | 425/392 |
| 3,991,458 | 11/1976 | Donoff | 29/234 |
| 4,077,344 | 3/1978 | Fletcher et al. | 72/370 |
| 4,155,242 | 5/1979 | Peterson | 72/392 |
| 4,276,010 | 6/1981 | Shartzer | 425/392 |
| 4,762,061 | 8/1988 | Watanabe et al. | 100/35 |
| 5,281,386 | 1/1994 | Weinert | 264/512 |
| 5,352,319 | 10/1994 | Ishizu et al. | 156/446 |

FOREIGN PATENT DOCUMENTS

| | | | |
|---|---|---|---|
| 2733643 | 2/1979 | Germany | 425/392 |
| 2120206 | 11/1983 | United Kingdom . | |

*Primary Examiner*—Robert B. Davis

*Attorney, Agent, or Firm*—Oblon, Spivak, McClelland, Maier & Neustadt

[57] ABSTRACT

A method and apparatus for shaping the center space of toilet rolls by inserting a shaping core into each end of the center space, and then withdrawing the cores. The diameter of each shaping core decreases toward the front end of the core.

5 Claims, 6 Drawing Sheets

APPARATUS FOR SHAPING THE CENTER SPACE OF TOILET ROLLS

BACKGROUND OF THE INVENTION

1. Field of the Invention

The present invention relates to a method and apparatus for shaping the space at the center of rolls of toilet paper.

2. Description of the Prior Art

There are toilet rolls that use a paper cylinder to form the space at the center of the roll, and there are toilet rolls that do not use such a paper cylinder, using instead the inner surface of the roll to form the center space. Each type of toilet roll is formed by winding a prescribed length of a wide strip of toilet paper to form a log roll, which is cut into sections of prescribed width to simultaneously form multiple toilet rolls. In the cutting process, the pressure of the cutter blade has the effect of deforming the roundness of the center space, whether a paper cylinder is being used or not.

This deformation has an adverse affect on the appearance of the toilet roll and degrades its commercial value, and in addition makes it difficult to insert a shaft into the center space to mount the toilet roll on a holder. When there is a large degree of deformation, the practice has been to insert a thin rod into the center space to manually restore it to a more or less round shape, but having to do this to the rolls one at a time is very time-consuming and inefficient.

Mechanizing the insertion of the rod is accompanied by the risk that in the insertion process, friction between the rod and the wall of the center space will cause tearing of the wall layers. Moreover, with some types of deformation it is difficult to ensure the proper shape of the roll, as the roll may soon revert to the deformed shape after the rod is simply inserted and withdrawn.

An object of this invention is to provide a method and apparatus that can reliably restore the round shape of the center space of toilet rolls without damaging the wall of the center space.

Another object of the invention is provide a method and apparatus for shaping the center space of toilet rolls automatically and with good efficiency.

SUMMARY OF THE INVENTION

For attaining the above objects the present invention comprises a shaping core that tapers toward the tip of the core which is located at the opening to the center space of the toilet roll, with the shaping core being inserted tip first into the center space and then withdrawn to thereby shape the center space opening.

If necessary, in performing the above shaping procedure the shaping core is rotated, or the shaping is carried out with the center space in a dampened state.

Thus, the tapered shape of the shaping core allows the core to be inserted into the center space of the toilet roll without subjecting the wall of the center to undue force, thereby avoiding damage to the wall. Also, rotating the shaping core during the insertion enables the center space, particularly the opening portion, to be enlarged to a specific inside diameter with a stable force.

Further features of the invention, its nature and various advantages will be more apparent from the accompanying drawings and following detailed description of the invention.

DESCRIPTION OF THE PREFERRED EMBODIMENT

Figure 1:
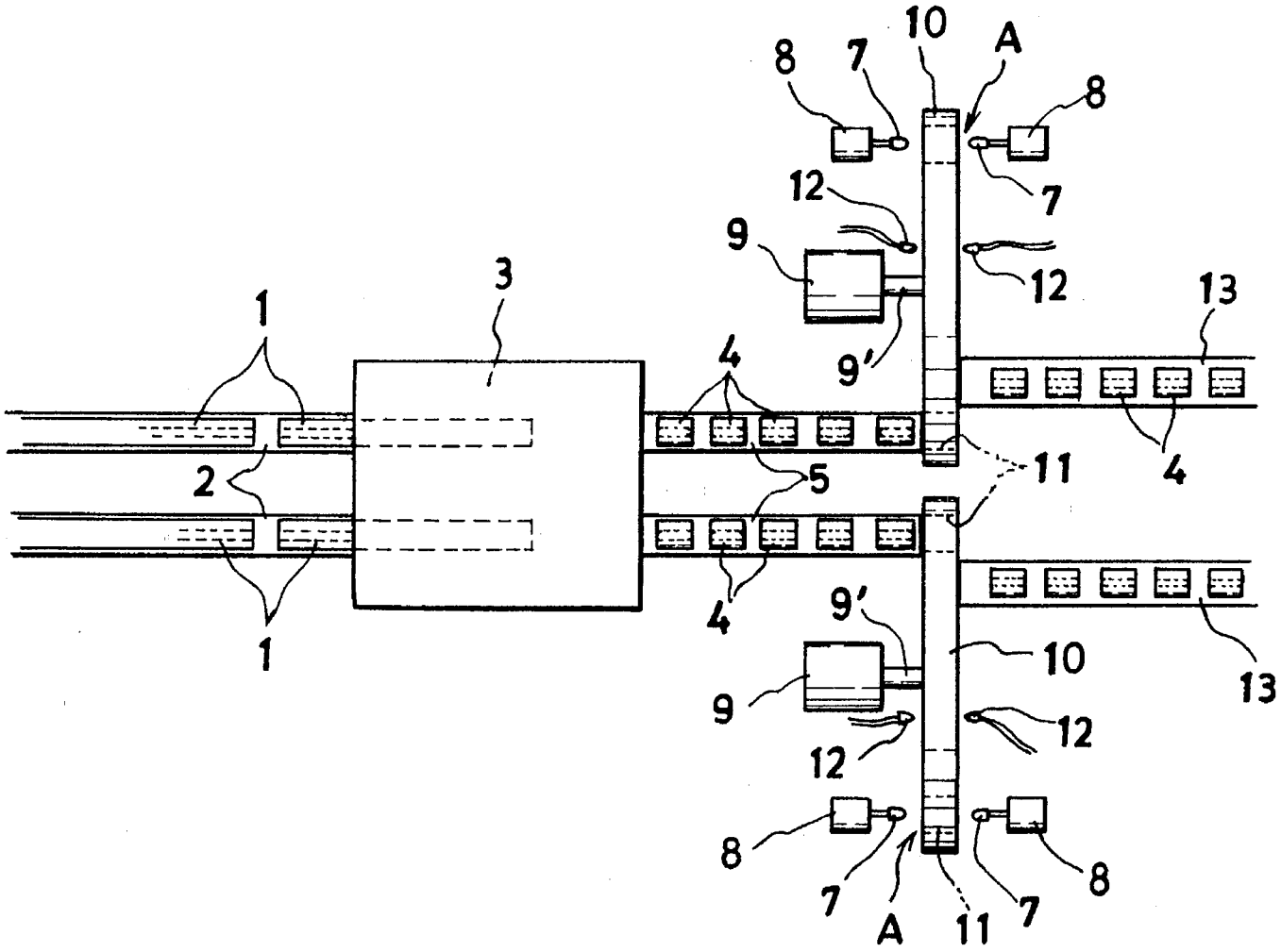
FIG. 1 is a plan view of a first embodiment of the apparatus for shaping the center space of a toilet roll according to the invention.

A first embodiment of the apparatus for shaping the center space of a toilet roll according to this invention will now be described, with reference to FIGS. 1 to 4.

In the drawings, reference numeral 1 denotes a log roll of a prescribed length of toilet paper (for example 65 meters), 2 is a belt conveyor for conveying the log roll 1 to a cutter 3, 4 is a plurality of toilet rolls, each cut to a prescribed size by the cutter 3, and 5 is a belt conveyor for conveying the toilet rolls 4. In this embodiment log rolls 1 are conveyed into the cutter 3 two at a time, and two conveyor belts 5 are used to carry the cut toilet rolls 4 from the cutter 3 to the shaping apparatus disposed at the end of each of the conveyor belts 5, where the center space of each of the toilet rolls 4 is shaped.

Any arrangement may be used for the cutter 3 that enables it to be used to cut the log rolls 1 to the requisite lengths. It may for example have a plurality of swinging arms disposed along the path of travel with a rotary cutter provided on the end of each arm, so that a log roll is simultaneously cut at multiple points. The conveyor belts 5 are operated at intermittent intervals so that the cut toilet rolls 4 are conveyed, with the center space aligned with the direction of travel, to the shaping apparatus at a prescribed timing.

In this embodiment the toilet rolls 4 are conveyed from the cutter 3 in two lines, and therefore two sets of shaping apparatuses are provided. The two sets are structurally the same, the only difference being that they are symmetrically configured at opposite sides. This being the case, from now on the description will be made with reference to just one shaping apparatus.

The shaping apparatus consists of the belt conveyor 5 which conveys toilet rolls 4 from the cutter 3 at prescribed intervals, with the center space of each toilet roll oriented in the direction of travel; a mechanism whereby each toilet roll conveyed by the belt conveyor 5 is moved to a shaping position A that is removed from the line of travel of the belt conveyor 5; a shaping core 7, arranged at the opening to the center space for insertion therein; a rotation mechanism 8 for rotating the shaping core 7; and a pusher device whereby a shaping core 7 that has been inserted into the center space of a toilet roll 4 is withdrawn. In shape, the diameter of the rear portion of the shaping core 7 is substantially the same as the inside diameter of the center space, and the diameter of the shaping core 7 gradually decreases toward the front end.

The moving mechanism shown in FIG. 1 is a large disk-shaped rotational conveyor 10 affixed to the drive shaft 9' of a drive motor 9. Formed around the periphery of the rotational conveyor 10 is a plurality of round compartments 11 in the form of through-holes which each accommodates one toilet roll 4, and the rotational conveyor 10 conveys the toilet rolls 4 by rotating through an angle that corresponds to the pitch of the compartments 11. In the illustrated example there are twelve such compartments 11, so the rotational conveyor 10 is rotated by an angle of 30 degrees at a time. The rotational conveyor 10 is positioned so that at one side the mouth of a compartment 11 is located at the end of the belt conveyor 5.

The motor 9 may be of any configuration that allows the rotational conveyor 10 to be rotated a prescribed angle at a time, such as a pulse motor, for example. To ensure that the toilet rolls 4 move smoothly from the belt conveyor 5 into the compartments 11, a chute 10 may be provided between the belt conveyor 5 and the rotational conveyor 10, or a known pusher device mechanism can be employed to push each of the toilet rolls 4 off of the end of the belt conveyor 5 and into a compartment 11. The compartments 11 are not limited to being round throughholes in a disk, but may be a bucket or any other such configuration that allows individual toilet rolls 4 to be accommodated and transported.

Figure 2:
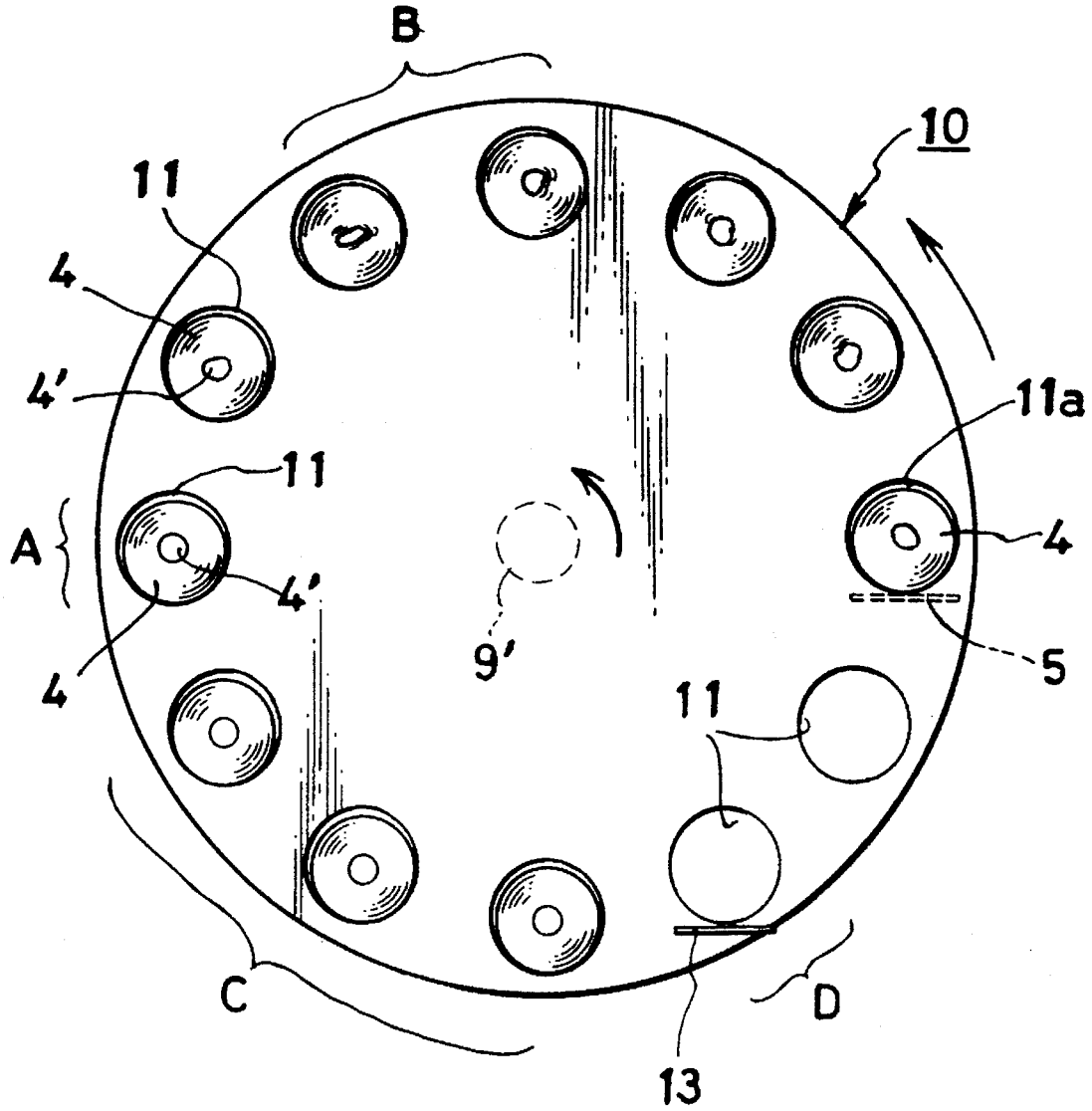
FIG. 2 is a front view of the rotational conveyor of the apparatus of FIG. 1.

FIG. 2 is a front view of the lower of the rotational conveyors 10 shown in FIG. 1, that is, as viewed from the right side, with respect to FIG. 1. In FIG. 2, the compartment 11*a* at the right side (i.e., where the numeral "3" would be if the rotational conveyor 10 were a clock) is positioned at the end of the belt conveyor 5 to receive one of the toilet rolls 4 brought by the belt conveyor 5. When the motor 9 is then operated, the rotational conveyor 10 is rotated 30 degrees counterclockwise (with respect to FIG. 2), moving the full compartment 11*a* to the 2 o'clock position and bringing an empty compartment 11 to the 3 o'clock position, whereby operating the belt conveyor 5 causes a toilet roll 4 to be put into the compartment 11 at that 3 o'clock position. In this way, the toilet rolls 4 are transported one after the other by rotating the rotational conveyor 10 by 30 degrees at a time, at a prescribed timing that there will be an empty compartment 11 at the 3 o'clock position to take the next toilet roll 4 from the belt conveyor 5.

In the case of this embodiment a dampening position B is provided at the 11 to 12 o'clock location of the rotational conveyor 10, a shaping position A is provided at the 9 o'clock position, a drying zone C at the 8 to 6 o'clock position and an ejection position D at the 5 o'clock position. Also, the dampening position B is provided with dampening nozzles 12 aimed at the compartments 11, while shaping core 7 and core rotation mechanism 8 are arranged at shaping position A and a drying means (not shown) such as a hot-air blower is provided at the drying zone C, while a belt conveyor 13 is provided at ejection position D to transport the toilet rolls 4 to the next process. Thus the rotation of the rotational conveyor 10 causes the toilet rolls 4 in the compartments 11 to be transported to the dampening position B, then to the shaping position A, then the drying zone C, and then to the ejection position D.

Figure 3:
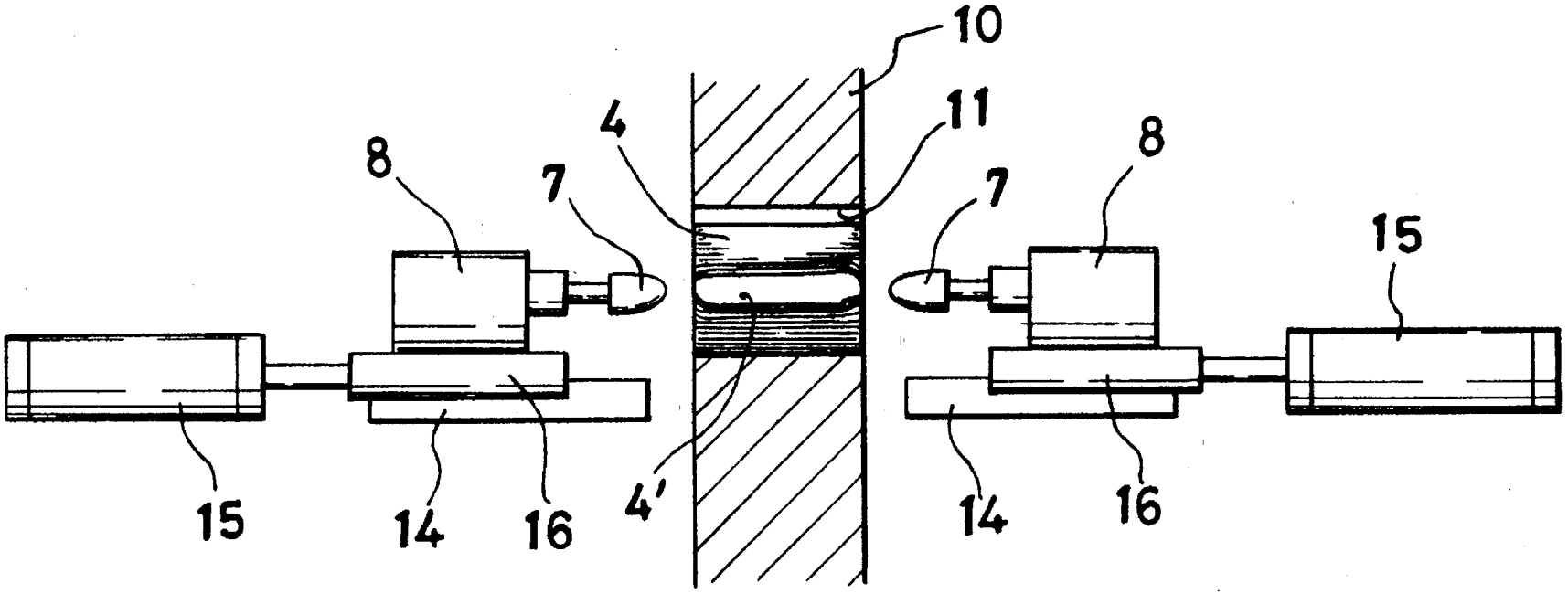
FIG. 3 is an explanatory view of the shaping core rotation and pusher device of the apparatus of FIG. 1.

The interval operation of the dampening nozzles 12 is synchronized with the rotation of the rotational conveyor 10 to cause a dampening fluid such as water to be sprayed into the center space of each toilet roll 4 to dampen the wall of the space. The rotational conveyor 10 is then rotated to move the dampened toilet roll 4 to the shaping position A At the shaping position A, as shown in FIG. 3, each side of the rotational conveyor 10 is provided with a slide rail 14, and a pusher device consisting of a drive cylinder 15 for moving a slider 16 along the slide rail 14, and affixed to the top of the slider 16 is a rotation mechanism 8 constituted by a motor with a reduction gear, and a round, tapered shaping core 7 is affixed to the drive shaft of the motor. The shaping core 7 is provided at a position that enables it to be inserted into the center space of a stationary toilet roll 4 at the shaping position A. The drive cylinder 15 is set to operate at a timing that matches the timing of the rotation of the conveyor 10.

Thus, when the drive cylinder 15 is operated while the shaping core 7 is being rotated by the motor 8, the slider 16 is moved forward to thereby insert the end of the shaping core 7 into the opening of the center space 4' of a toilet roll 4. Even if the opening is deformed, the small diameter of the end of the shaping core 7 enables it to be inserted into the center space 4' and expand the opening to its round shape. If the shaping core 7 is rotated, it allows the insertion to proceed with a stable frictional force between the core and the wall of the center space, avoiding the application of undue force that could damage the paper constituting the wall. When a prescribed time period has passed and the shaping core 7 has penetrated to a required depth, the drive cylinder 15 is activated to retract the slider 16, withdrawing the shaping core 7 from the center space 4'.

At the shaping position A, as shaping cores 7 are inserted simultaneously into the center space 4' from both ends of the toilet roll 4, the toilet roll 4 is not dislodged from the compartment 11. Similarly, the shaping cores 7 are withdrawn simultaneously, preventing a toilet roll 4 being pulled out of the compartment 11 on one shaping core 7.

In this way, at the shaping position A the deformed center space 4' of a toilet roll 4 is returned to a substantially round shape by the shaping cores 7 being inserted into, and withdrawn from, the center space 4'. The dampened state of the center space 4' enables it to be more readily expanded by the shaping cores 7, and the weak spring-back of the toilet paper ensures that it holds its shape and does not revert to its deformed state after the withdrawal of the shaping cores 7.

After being shaped at the shaping position A the toilet roll 4 is moved by the rotational conveyor 10 to the drying zone C, where it is dried, and it is then moved to the ejection position D. Thus, by the time it has reached the ejection position D the center space 4' of the toilet roll 4 has been reshaped to the round and dried to enable it to maintain its shape over an extended period of time. At the ejection position D a pusher device ejects the toilet roll 4 from the compartment 11 onto the belt conveyor 13 to be conveyed onwards for other steps of the production process such as inspection and packaging.

In the above embodiment the inside wall of the center space 4' is dampened by being directly sprayed with a dampening fluid by the dampening nozzles 12 disposed at the dampening position B. However, the invention is not limited to this arrangement. An arrangement such as the one shown in FIG. 4 may be used, for example, in which there are dampening nozzles 12 disposed at the shaping position A to spray fluid on the shaping core 7 after each retraction, so that the shaping core 7 is wetted prior to insertion.

Figure 4:
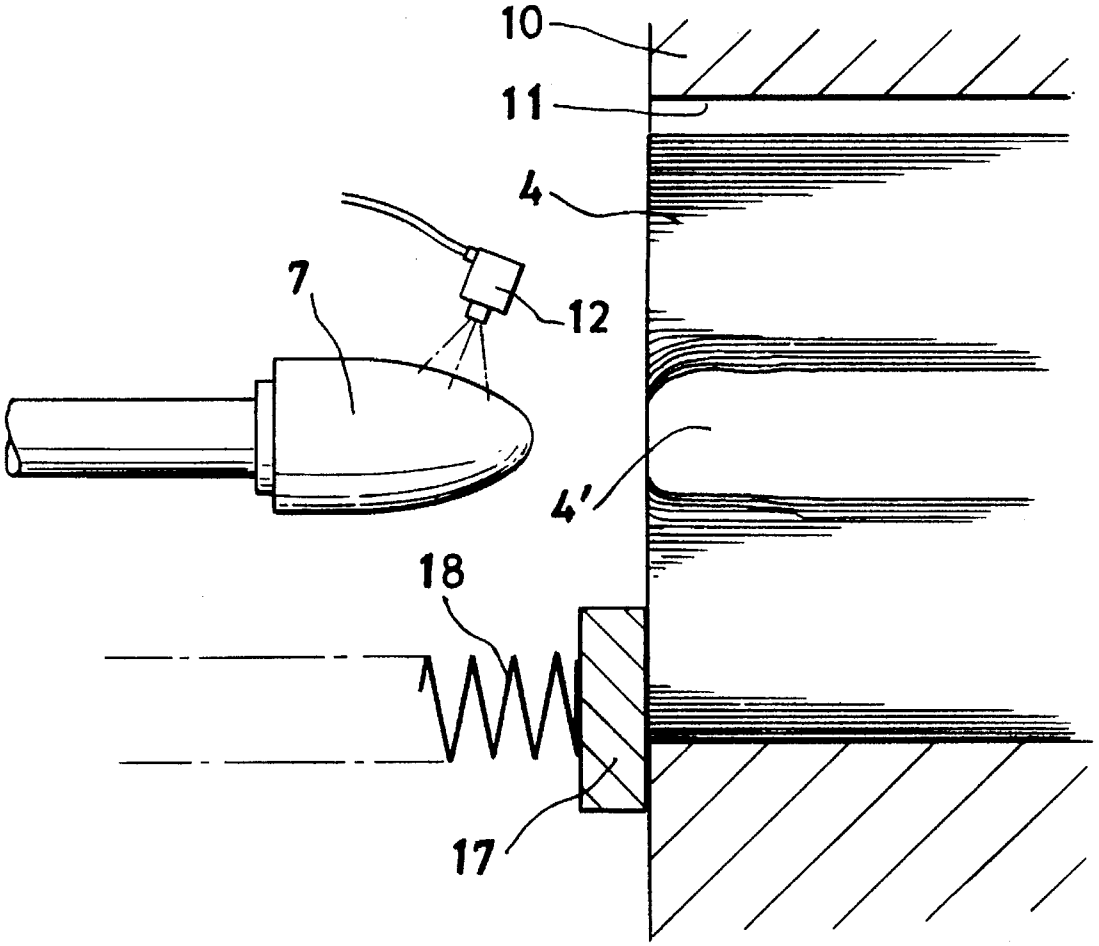
FIG. 4 is an explanatory view showing the shaping core coated with fluid.

Again, while in the above embodiment shaping cores 7 are inserted into the center space 4' simultaneously from both sides, and are also withdrawn simultaneously, to prevent toilet rolls 4 being dislodged from the compartments 11, an arrangement such as that shown in FIG. 4 may be used in which a toilet roll 4 is kept in place by a retaining member 17 under the force of a spring 18 disposed between the retaining member 17 and the slider 16. When the slider 16 is in a retracted position the retaining member 17 is not pressed against the rotational conveyor 10 and toilet roll 4, so the rotational conveyor 10 is free to rotate. When the sliders 16 start to be moved to their forward position, before the insertion of each of the shaping cores 7 into the center space 4' the retaining member 17 at each side presses against the edge of the opening of the compartment 11, reducing the area of the opening. By then further advancing the sliders 16 the shaping cores 7 are inserted into the center space 4', rounding the shape of the center space starting from the openings. Therefore, even if one of the shaping cores 7 is inserted slightly before the other, the toilet roll 4 will be held in place in the compartment 11 by the retaining member 17 on the other side. Also, the retaining members 17 at each side prevent the toilet roll 4 from being rotated by the rotation of the shaping cores 7 as they enter the center space 4'.

Also, even if the retraction of the sliders 16 to withdraw the shaping cores 7 from the center space is not effected at precisely the same time, the toilet roll 4 in the compartment 11 is held in place by the retaining member 17 on the side of the shaping core 7 that is slower to withdraw, preventing the withdrawal of that shaping core 7 from pulling the toilet roll 4 out of the compartment 11.

In the above-described first embodiment toilet rolls 4 are transported from the cutter 3 by the belt conveyor 5 and then moved laterally by a turret-style rotational conveyor 10 to the shaping position A. However, the transport mechanisms of the invention are not limited thereto, but may be any mechanisms which are capable of moving the toilet rolls 4 to the shaping position A with the center space 4' oriented in the direction of travel.

Figure 5:
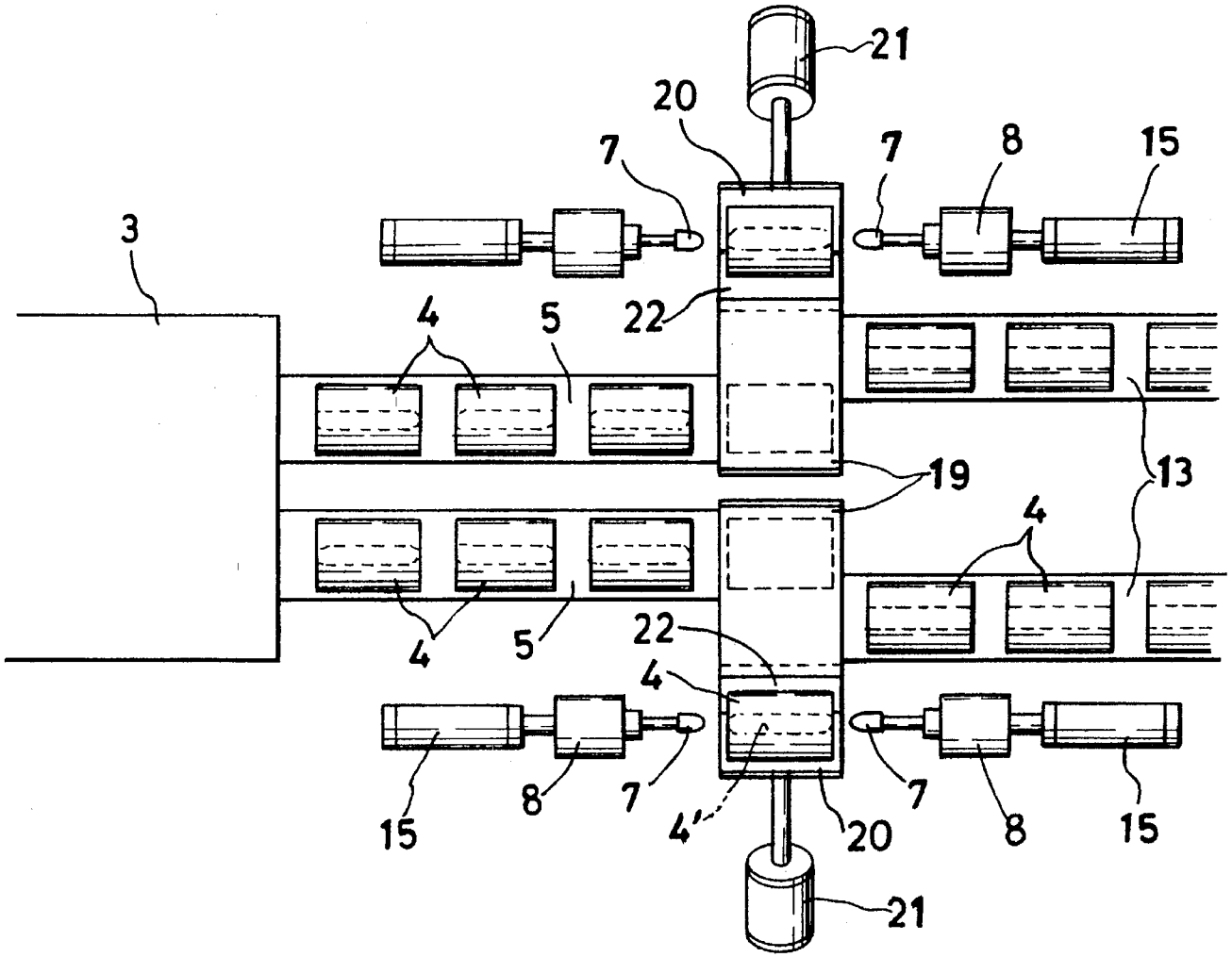
FIG. 5 is a plan view of a second embodiment of the apparatus of the invention.
Figure 6:
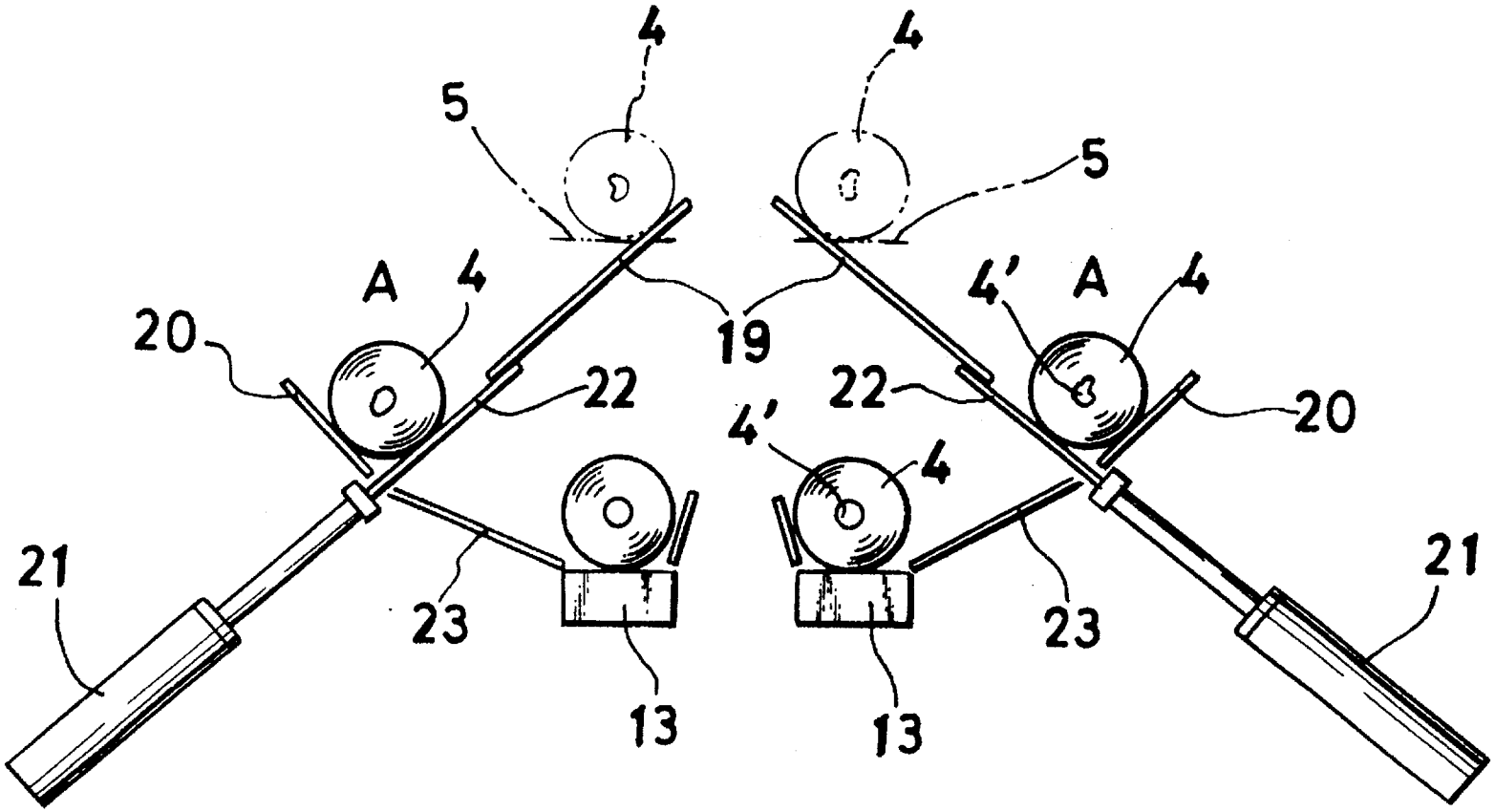
FIG. 6 is a front view of the transport mechanism of the apparatus of FIG. 5.

For example, there is the arrangement of a second embodiment illustrated by FIGS. 5 and 6. In this arrangement, the transport mechanism consists of a first chute 19 disposed with the start of the chute at the end of a conveyor belt 5, and toilet rolls 4 roll down the first chute 19 onto a support member 20 constituting shaping position A, below which is an opening covered by a shutter 22 which is opened and shut by an air cylinder 21. A second chute 23 is provided between the opening at the lower end of the first chute 19 and a belt conveyor 13. As in the case of the first embodiment, this embodiment is also provided at each side with a mechanism for rotating the shaping cores 7 and another mechanism for advancing and retracting the shaping cores 7, and prior to insertion the shaping cores 7 are wetted by a fluid emitted by nozzles 12. The shutter 22 is normally in the closed position.

When the interval operation of the belt conveyor 5 is initiated the leading toilet roll 4 drops from the belt onto the first chute 19 and rolls down the chute until stopped at the shaping position A by the support member 20. The shaping cores 7 are then wet by fluid from the dampening nozzles 12 (see FIG. 4) and are rotated by the rotating mechanisms. The drive cylinders 15 are then activated to insert the rotating shaping cores 7 into the center space 4' of the toilet roll 4, to shape the opening of the center space. After a prescribed time period has elapsed, the drive cylinders 15 withdraw the shaping cores 7 from the center space 4'.

When the center space 4' has thus been shaped, the air cylinder 21 is activated to open the shutter 22, allowing the toilet roll 4 at the shaping position A to roll down the second chute 23 and onto the belt conveyor 13, which transports the toilet roll 4 to the next process. Meanwhile, the air cylinder 21 closes the shutter 22 and the belt conveyor 5 is activated to furnish the next toilet roll 4.

In the above embodiments the shaping core 7 is rotated for insertion into the center space of the toilet roll 4, but the shaping core 7 may instead be inserted without being rotated.

In accordance with this invention as described above, a toilet roll center space deformed by the log roll cutting operation can be restored to a round shape by inserting a rotating or non-rotating shaping core into the center space. Also, the diameter of the shaping core decreases toward the front end. This shape ensures a stable frictional force between core and center space wall during the insertion process that does not tear the toilet paper constituting the inner wall. This effect is enhanced if the shaping core is rotated during the insertion. Dampening the center space prior to insertion can further ensures that there is virtually no spring-back and facilitates the shaping of the toilet roll and, after being dried, makes it possible for the toilet roll to hold its shape for an extended period of time.

What is claimed is:

1. An apparatus for shaping a center space of a toilet roll, comprising:

transport means whereby toilet rolls, each having a center space, are conveyed at set intervals with said center space oriented in a direction of travel;

means of moving each toilet roll thus transported to a dampening position and a shaping position;

a dampening nozzle for dampening the toilet roll center space at the dampening position;

a shaping core that has a smaller diameter toward a front end and a rear end diameter substantially the same as an inside diameter of the toilet roll center space and is located at the shaping position at an opening to the toilet roll center space; and drive means for inserting the shaping core from the front end thereof into the toilet roll center space from an opening and retracting the shaping core that has been inserted into the center space.

2. An apparatus according to claim 1, further comprising means for rotating the shaping core.

3. An apparatus according to claim 1, further comprising a second shaping core disposed at a second end of the toilet roll center space.

4. An apparatus according to claim 1, wherein the dampening nozzle is a device for spraying a dampening fluid into the toilet roll center space.

5. An apparatus according to claim 1, wherein the dampening nozzle is a device for spraying a dampening fluid onto the shaping core.

* * * * *